US005103665A

United States Patent [19]

van Merksteijn

[11] Patent Number: 5,103,665

[45] Date of Patent: Apr. 14, 1992

[54] PRESS AND AN AUTOMATIC CURVE-FORMING DEVICE THEREFOR

[75] Inventor: Jacobus L. van Merksteijn, GN Stad Delden, Netherlands

[73] Assignee: Machinefabriek Wila B.V., Lochem, Netherlands

[21] Appl. No.: 705,776

[22] Filed: May 28, 1991

Related U.S. Application Data

[63] Continuation of Ser. No. 539,834, Jun. 18, 1990, abandoned.

[30] Foreign Application Priority Data

Jun. 21, 1989 [NL] Netherlands ..... 89 01560

[51] Int. Cl.[5] ..... B21D 5/02

[52] U.S. Cl. ..... 72/389; 72/446; 72/452; 72/482

[58] Field of Search ..... 72/10, 11, 389, 412, 72/446, 452, 462, 482

[56] References Cited

U.S. PATENT DOCUMENTS

| | | | |
|---|---|---|---|
| 4,347,727 | 9/1982 | Galiger | 72/389 |
| 4,354,374 | 10/1982 | Deguchi | 72/448 |
| 4,564,765 | 1/1986 | Blaich | 72/389 |
| 4,732,032 | 3/1988 | Kogure | 72/389 |
| 4,802,357 | 2/1989 | Jones | 72/389 |
| 4,930,339 | 6/1990 | Corsini | 72/389 |

FOREIGN PATENT DOCUMENTS

| | | | |
|---|---|---|---|
| 67766 | 12/1982 | European Pat. Off. . | |
| 330258 | 8/1989 | European Pat. Off. . | |
| 52-5464 | 1/1977 | Japan . | |
| 0144527 | 8/1984 | Japan | 72/389 |
| 0166123 | 8/1985 | Japan | 72/389 |
| 244425 | 12/1985 | Japan | 72/389 |
| 34624 | 2/1987 | Japan | 72/389 |

*Primary Examiner*—David Jones

*Attorney, Agent, or Firm*—Christensen, O'Connor, Johnson & Kindness

[57] ABSTRACT

The invention relates to a press such as a folding press and a deep-draw press comprising a press frame with a lower yoke and an upper yoke which are mutually reciprocally movable, wherein the lower yoke and the upper yoke are each provided with co-acting tools and wherein between a yoke and its tool are arranged a curve forming device which comprises a series of curve-forming wedge pairs which lie distributed over the length of the yoke between the yoke and the tool, wherein each curve-forming wedge pair is provided with an apparatus for adjusting the mutual position of the curve-forming wedges of a curve-forming wedge pair.

15 Claims, 2 Drawing Sheets

Fig. 1.
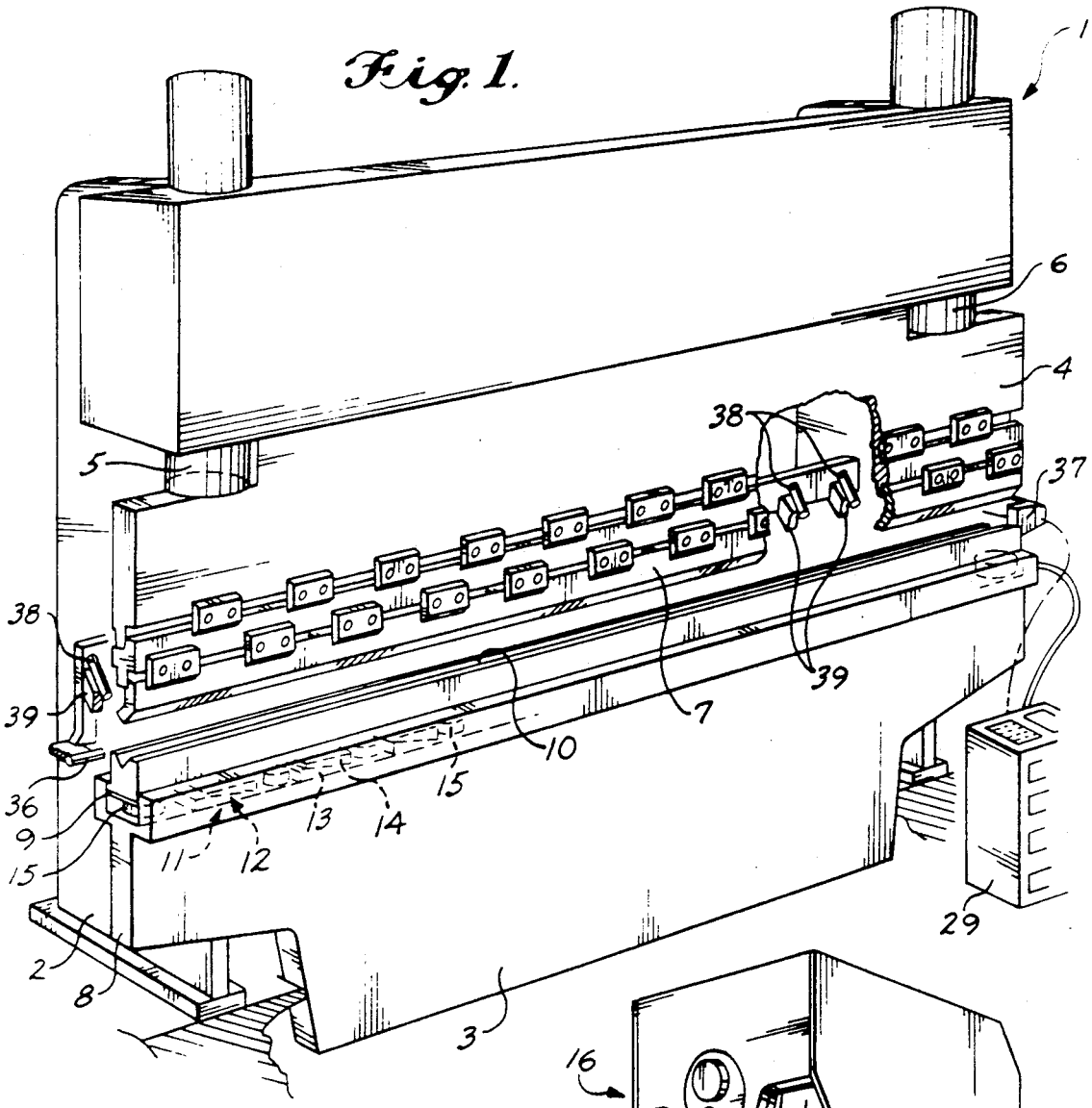
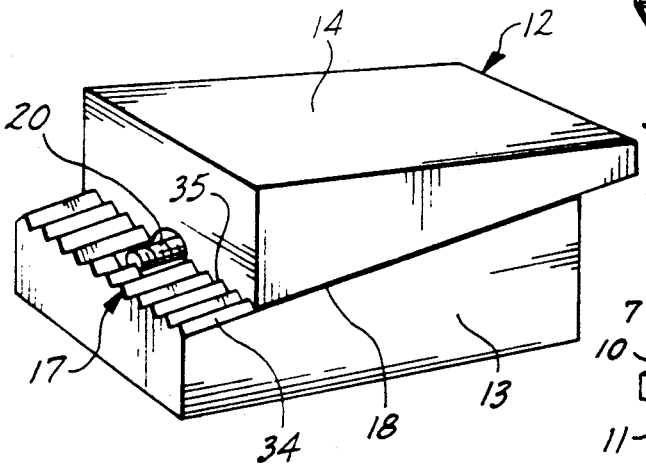
Fig. 6.
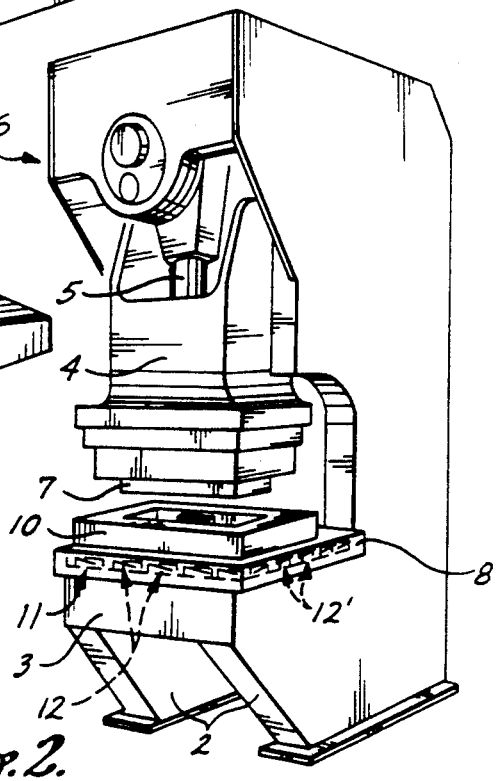
Fig. 2.

PRESS AND AN AUTOMATIC CURVE-FORMING DEVICE THEREFOR

This is a continuation of the prior application Ser. No. 07/539,834, filed June 18, 1990, now abandoned. The benefit of the filing date of which is hereby claimed under 35 U.S.C. § 120.

BACKGROUND OF INVENTION

The present invention relates to a press, such as a folding press or a deep-draw press, which comprises a press frame with a lower yoke and an upper yoke which are mutually reciprocally movable with reciprocating means, wherein the lower yoke and the upper yoke are each provided with co-acting tools and wherein between a yoke and its tool are arranged curve-forming means which comprise at least one pair of curve-forming wedges.

Such a press is known and is provided with curve-forming devices for the purpose of compensating during pressing or bending for deformations occurring in the diverse components of the press as well as in the materials for shaping.

EP-A-67.766 describes a press wherein the curve-forming means are formed by one pair of curve-forming wedges extending over the whole length of the press. The top wedge is provided along its length with a number of bolts which via a toothed wheel are all connected mutually and to an adjusting motor by means of a chain. A variation in the sideways movement of the top wedge 7 along its length is possible due to a difference in mutual pitch of the bolts or a differing number of teeth of a toothed wheel for a bolt.

EP-A-330.258 describes a press wherein the curve-forming wedges of a pair are mutually slidable in lengthwise direction of the press. In order to reduce the total height of a curve-forming wedge pair each curve-forming wedge can be embodied as two mutually connected wedge portions, the wedge surfaces of which connect to one another discontinuously.

Variations can be of diverse origin:

a) during pressing or bending the press sags as a consequence of the applied load. This sag line can be calculated but varies depending on the case of loading. When the load is short and concentrated the sag line has a shape other than with a load which runs the support points of the reciprocating means, for example the hydraulic cylinders. Extreme variations occur if the load extends laterally beyond the support points or if the press is loaded eccentrically;

b) the lower yoke and the upper yoke and the tools have linearity deviations, the consequences of which are recognizable in the pressed or bent products;

c) the tools used generally have dimensional variations which can only be reduced at increasingly excessive cost;

d) as a result of wear, location-dependent dimensional variations occur in the tools used; and e) the material used that is to be worked is not completely homogeneous (grain size distribution), has no constant material thickness and has unevenly distributed stresses, as a result among other things of rolling, so that location-dependent varying deformation properties occur.

A number of these variations are predictable, a number of other variations vary or manifest themselves during prolonged use of the press or in the case of use of different materials for working. There therefore exists a need for curve-forming means that are adjustable optimally and as accurately as possible. This adjustment has preferably to be possible independently from place to place along the length of the yoke.

It is moreover desirable that the curve-forming means have the simplest possible form and construction.

SUMMARY OF THE INVENTION

The invention has for its object to satisfy the above described requirements and provides a press characterized in that it comprises a press frame with a lower yoke and an upper yoke which are mutually reciprocally movable with reciprocating means, wherein the lower yoke and the upper yoke are each provided with co-acting tools, wherein between a yoke and its tool are arranged curve-forming means which comprise a series of curve-forming wedge pairs, which pairs are located along the length of the yoke distributed between the yoke and the tool, wherein each curve-forming wedge pair is provided with energizable adjusting means for adjusting the mutual position of the curve-forming wedges of a curve-forming wedge pair.

The press according to the invention comprises different types of press for two- or three-dimensional shaping of plate-like material, such as a folding press and a deep-draw press.

The press further comprises a relieving means for relieving a force applied to the curve-forming wedges by the tool. Each pair of curve-forming wedges can be provided with its own adjusting means, for instance, an adjusting motor of low power and a stop which prevents movement of the curve-forming wedges in relationship to each other after adjustment of the curve-forming wedges.

In a first preferred embodiment the relieving means consist of lifting means with which a cover plate resting on the pair of curve-forming wedges is liftable therefrom. In this way only a load is in principle exerted on the adjusting motor during adjusting which is dependent on the upper, slidable curve-forming wedge.

According to a second preferred embodiment the relieving means comprise a relieving strip with which a curve-forming wedge resting against the stop is releasable therefrom. In this case the adjusting motor needs only to displace its stop because using the relieving strip the slidable curve-forming wedge is taken out of contact with the stop and, after adjusting using the adjusting means, the wedge is re-placed and strikes against the stop. Resetting of the slidable curve-forming wedge is preferably realized with spring means acting counter to the relieving strip and releasing the curve-forming wedge therefrom prior to adjusting.

It will be apparent that the use of relieving means can be omitted if the adjusting means possess a sufficient power or the curve-forming means possess sufficient power or the curve-forming means are located between the upper yoke and the tool suspended therefrom.

An optimal construction for the pair of curve-forming wedges and the adjusting means is obtained if the stop is arranged on a spindle of the adjusting means which extends substantially in the sloping contact surface of the pair of curve-forming wedges. In this case the spindle is optimally guided and the mutually exerted forces are minimal. A very compact pair of curve-forming wedges is obtained if more preferably the adjusting means comprising the adjusting motor are enclosed by the pair of curve-forming wedges, for instance if in the wedge surfaces of the curve-forming wedges an adjusting motor cavity is present.

In order to enable a greater angle of slope for the wedge surfaces making mutual contact, without the self-braking effect being lost, the wedge surfaces of the pair of curve-forming wedges are preferably provided with ribs making mutual fitting contact. In this way the co-acting curve-forming wedges make mutually fitting contact because the rib edges rest against each other, thereby resulting in a larger angle of friction.

In the case of use of a large number of pairs of curve-forming wedge pairs in line orientation (for example in a folding press) as well as in a plane orientation (for example in a deep-draw press), it is recommended that the adjusting means, namely the adjusting motors, of each curve-forming wedge pair are connected to a central processing/operating unit so that each pair of curve-forming wedges is selectively adjustable in order to compensate optimally for the variations occurring during pressing. It is moreover possible to embody the curve-forming wedges in cheaper materials, for example fibre-reinforced plastics, because the curve-forming characteristic of each curve-forming wedge pair is known in advance and variations that may occur later can be easily measured and compensated using the central processing/operating unit.

Finally, the invention also relates to a curve-forming device comprising a series of mutually separated curve-forming wedge pairs according to the invention.

BRIEF DESCRIPTION OF THE DRAWINGS

Mentioned and other features of the press and curve-forming means according to the invention will be further elucidated hereinafter on the basis of a number of embodiments which are given only by way of example and with reference to the annexed drawings.

FIG. 1 shows a perspective view of a folding press;

FIG. 2 shows a perspective view of a deep-draw press;

FIG. 6 is a variant of detail VI from FIG. 3.

DETAILED DESCRIPTION OF THE PREFERRED EMBODIMENTS

Figure 3:
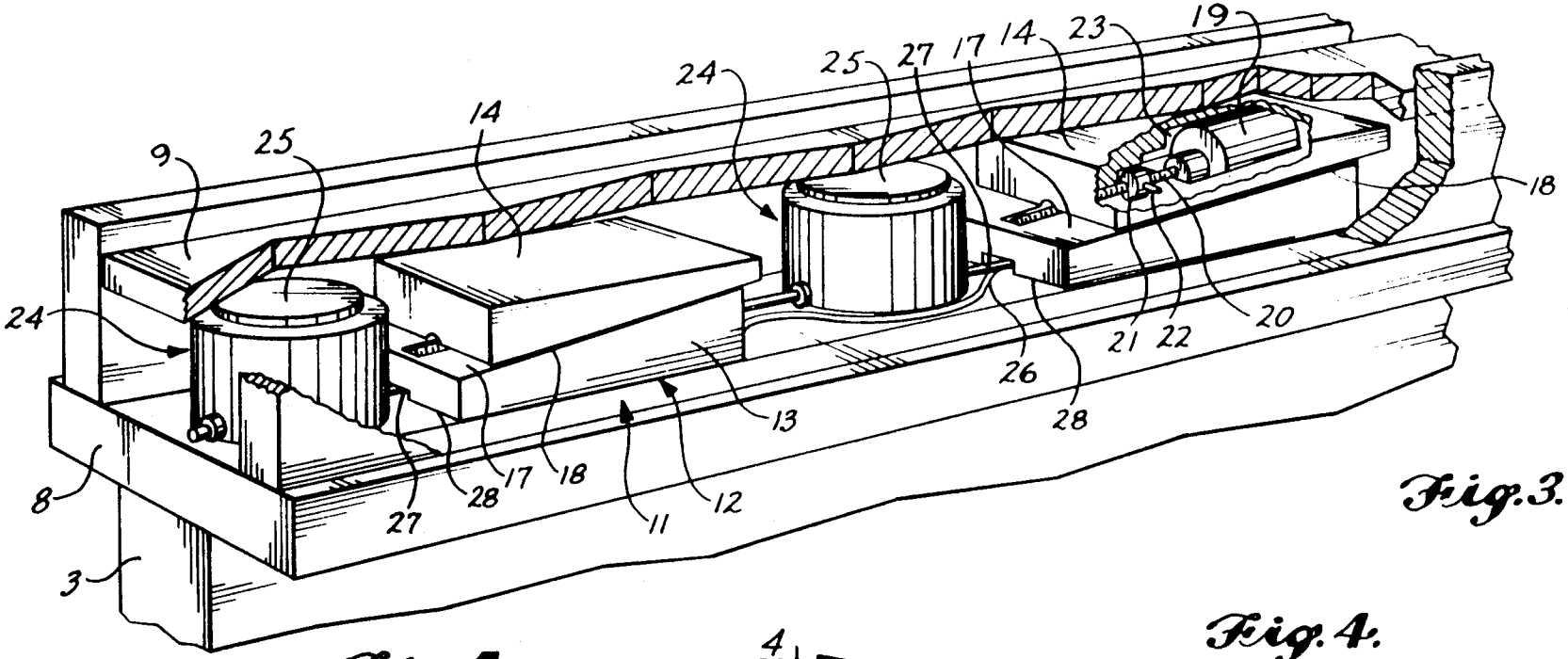
FIG. 3 shows on a larger scale a partly broken away perspective view of detail III from FIG. 1.

FIG. 1 shows a folding press 1 according to the invention with a press frame 2 bearing a lower yoke 3 and on which is suspended an upper yoke 4. The upper yoke 4 is reciprocally movable relative to lower yoke 3 using hydraulic cylinders 5 and 6.

The upper yoke 4 is provided with a bending tool 7 which is fixed to the upper yoke 4 in conventional manner.

The lower yoke 3 is provided with a trough-like table 8 closed off with a cover plate 9 on which lies, as bending tool, a bending beam 10.

The curve-forming means 11 according to the invention are arranged in the trough-like table 8. The curve-forming means comprise a series of (for instance twenty) curve-forming wedge pairs 12 which comprise curve-forming wedges 13 and 14 which in this embodiment are separated in lengthwise direction of the table 8 by relieving means 15 according to the invention.

FIG. 2 shows a deep-draw press 16 according to the invention wherein construction components corresponding with those of the folding press 1 according to the invention of FIG. 1 are designated with the same reference numerals. In this case the table 8 is provided with curve-forming means 11 comprising curve-forming wedge pairs 12 which extend distributed over the surface in one or two directions. Each curve-forming wedge pair 12 is adjustable independently of the other curve-forming wedge pairs 12.

FIG. 3 shows in more detail the curve-forming means 11 according to the invention. The curve-forming means comprise curve-forming wedge pairs 12 comprising curve-forming wedges 13 and 14 which make mutual contact with a sloping wedge surface 17 and form a contact surface 18. The bottom curve-forming wedge 13 is stationary and the top curve-forming wedge 14 is adjustable in the direction of the slope of the contact surface 18 relative to the curve-forming wedge 13 by means of the adjusting means comprising an adjusting motor 19, for instance a stepping motor or DC motor, which can drive a threaded spindle 20 onto which is screwed a nut 21 with studs 22.

The wedge pair 12 encloses the stepping motor 19 because both curve-forming wedges 13 and 14 are provided with a cavity 23 the form whereof is adapted to the stepping motor 19, the threaded spindle 20 and the nut 21 with studs 22.

The stepping motor 19 can be a very simple, low-power stepping motor (for example four-phase motor; electronically controlled, 1.75 Watts), since prior to adjustment the relieving means 24 are energized. These relieving means 24 comprise lifting members 25 which raise the cover plate 9, whereby the curve-forming wedge 14 rests substantially with its own weight on the contact surface 18. With an adjusting height of 10 mm per 150 mm of length and an adjusting path of 50 mm, at a threaded spindle pitch of 2 mm the adjusting time can remain short, for example 2–3 seconds.

Signals for energizing the separate stepping motors 19 and the relieving means 24 are fed via wires 26 which pass through grooves 27 in the bottom 28 of the lower curve-forming wedge 13 and are fed to the central processing and operating unit 29. It is thus possible to adjust each wedge pair independently in any desired sense to obtain a determined adjusting height.

Figure 4:
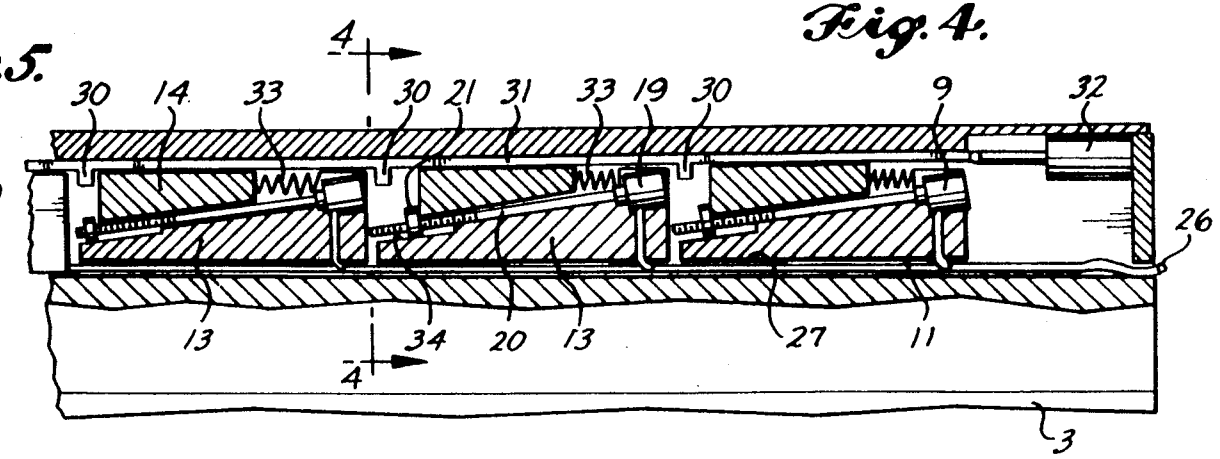
FIG. 4 is a view of a lengthwise section of a second embodiment of the curve-forming means according to the invention.
Figure 5:
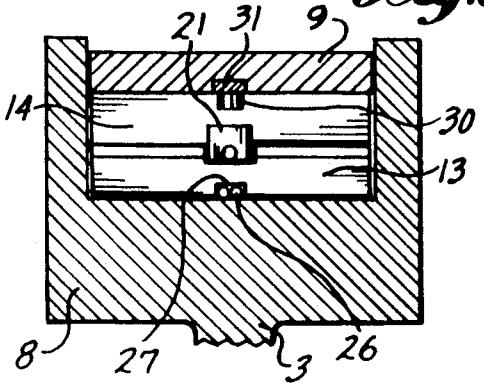
FIG. 5 is a section along the line V—V from FIG. 4.

In the embodiment of FIG. 4 the curve-forming means 11 comprise a relieving strip 31 provided with stops 30 which is reciprocally slidable with a motor 32. Using the stops 30 the top curve-forming wedges 14 can be released counter to the spring bias of spring means 33 from the nuts 21 acting as stop 21 which are threaded onto the screwed spindles 20 of each stepping motor 19. In this way the nut 21 can be adjusted with a very small load to any desired position in the nut path 34, whereafter by sliding the relieving strip 31 to the left the top curve-forming wedges 14 displace under spring force over the contact surface 18 until they strike against the stop 21 which is set at a predetermined and required position. In the same way the information for the position and energizing of each stepping motor 19 is coupled via information wires 26 to the central processing and operating unit 29.

It is remarked that the contact surface 18 has an inclination such that the co-acting curve-forming wedges 13 and 14 are self-braking. A greater inclination for the contact surface 18 for a greater adjusting height is possible by providing the wedge surfaces 17 as according to FIG. 6 with ribs 34 and 35 running in the direction of the inclination which rest in each other's edges, thus markedly increasing the contact surface. Through the use of the relieving means 24 according to the invention it is for instance possible to use a glass fibre-reinforced plastic for the curve-forming wedges 13 and 14. The plastic DF-1008 is for instance suitable because this plastic can withstand a pressure strength of for example 165 MPa, which corresponds to approximately 60 tons per pair of curve-forming wedges.

In the case of the relieving means 24 it is possible to use as lifting elements mechanical (resilient) or pneumatically, hydraulically or electrically driven lifting means.

In the case of the central processing and operating unit 29 the relieving means are first energized thereby prior to adjusting wedge pairs independently and in any desired direction with the stepping motors 19.

The press 1 or 16 according to the invention can be provided with sensors (lasers) with which the result of the pressing operation can be observed. For instance in the case of the folding press 1 the torsion of the shaped object can be determined with an axial sensor 36 and a detector 37 and the arranged angle of fold with a number of transverse sensors 38 with detectors 39 arranged over the length of press 1. Observed variations can thus be detected and after processing in the processing unit 29 the curve-forming can be adjusted through adjustment of one or more curve-forming wedge pairs in order to compensate for these observed variations.

The embodiments of the invention in which an exclusive property or privilege is claimed are defined as follows:

1. A press such as a folding press and a deep draw press, the press comprising:

(a) a press frame comprising:

(1) a lower yoke;

(2) an upper yoke;

(3) reciprocating means for reciprocally moving the upper yoke and the lower yoke; and (4) a pair of coacting tools, wherein one of said tools is located on the upper yoke and the other said tool is located on the lower yoke, wherein the reciprocating means causes said tools to engage each other; and (b) a plurality of curve forming wedge pairs located between each said yoke and its corresponding tool, wherein each curve-forming wedge pair comprises:

(1) a top wedge;

(2) a bottom wedge; and (3) adjusting means for adjusting each curve-forming wedge pair such that adjustment of each curve-forming wedge pair alters a curve that said tool deforms into upon engagement of the pair of coacting tools, the adjusting means includes a stop located adjacent to the top wedge such that the stop prevents movement of the top wedge relative to the bottom wedge along a sloping contact surface between the top wedge and the bottom wedge.

2. The press as claimed in claim 1, wherein the press further comprises means for relieving a force applied to said curve-forming wedge pairs by one of said tools such that said curve-forming wedge pairs can be easily adjusted.

3. The press as claimed in claim 2, wherein the relieving means further comprises a relieving strip which engages the top wedge such that the top wedge is moved out of contact with the stop.

4. The press as claimed in claim 2, wherein the relieving means comprises a means for lifting one of said tools.

5. The press as claimed in claim 1, wherein each curve-forming wedge pair further comprises a spring biasing means which engages the top wedge and biases the top wedge against the stop.

6. The press as claimed in claim 1, wherein the adjusting means further comprises a threaded spindle which extends substantially along the sloping contact surface between the top wedge and the bottom wedge, and wherein the stop is threaded onto the spindle.

7. The press as claimed in claim 10, wherein the sloping contact surface between the top wedge and the bottom wedge is provided with a series of ribs making mutual fitting contact.

8. The press as claimed in claim 1, wherein the adjusting means comprises an adjusting motor.

9. The press as claimed in claim 8, wherein each curve-forming wedge pair comprises an adjusting motor cavity located within each curve-forming wedge pair, wherein the adjusting motor is enclosed within the motor cavity.

10. The press as claimed in claim 1, wherein said adjusting means is connected to a central processing-/operating unit.

11. The press as claimed in claim 10, wherein said curve-forming wedge pairs are connected for independent adjustment to the central processing/operating unit.

12. The press as claimed in claim 10, wherein sensor means are connected to the processing/operating unit with which the result of the processing operation on a worked product is recorded.

13. A press such as a folding press and a deep draw press, the press comprising:

(a) a press frame comprising:

(1) a lower yoke;

(2) an upper yoke;

(3) reciprocating means for reciprocally moving the upper yoke and the lower yoke; and (4) a pair of coacting tools, wherein one of said tools is located on the upper yoke and the other said tool is located on the lower yoke, wherein the reciprocating means causes said tools to engage each other; and (b) a plurality of curve-forming wedge pairs located between each said yoke and its corresponding tool, wherein each curve-forming wedge pair comprises adjusting means for adjusting each curve-forming wedge pair such that adjustment of each curve-forming wedge pair alters a curve that said tool deforms into upon engagement of the pair of coacting tools, and wherein each curve-forming wedge pair includes a cavity for at least partially enclosing the adjusting means.

14. The press as claimed in claim 13, wherein the adjusting means comprises an adjusting motor.

15. A press such as a folding press and a deep draw press, the press comprising:

(a) a press frame comprising:

(1) a lower yoke;

(2) an upper yoke;

(3) reciprocating means for reciprocally moving the upper yoke and the lower yoke; and (4) a pair of coacting tools, wherein one of said tools is located on the upper yoke and the other said tool is located on the lower yoke, wherein the reciprocating means causes said tools to engage each other; and (b) a plurality of curve-forming wedge pairs located between each said yoke and its corresponding tool, wherein each curve-forming wedge pair comprises a top wedge and a bottom wedge, and adjusting means for adjusting each curve-forming wedge pair such that adjustment of each curve-forming wedge pair alters a curve that said tool deforms into upon engagement of the pair of coacting tools, further wherein the adjusting means comprises a threaded spindle which extends substantially along a sloping contact surface between the top wedge and the bottom wedge.

* * * * *

UNITED STATES PATENT AND TRADEMARK OFFICE

CERTIFICATE OF CORRECTION

PATENT NO. : 5,103,665

DATED : April 14, 1992

INVENTOR(S) : J. L. van Merksteijn

It is certified that error appears in the above-identified patent and that said Letters Patent is hereby corrected as shown below:

| COLUMN | LINE | |
|---|---|---|
| 3 | 32 | "Mentioned" should read --The above-mentioned features-- |
| 6 (Claim 7, | 15 Line 1) | "Claim 10" should read --Claim 1-- |

Signed and Sealed this

Twentieth Day of July, 1993

*Attest:*

Michael K. Kirk

MICHAEL K. KIRK

*Attesting Officer*

*Acting Commissioner of Patents and Trademarks*